US007344339B1

(12) United States Patent
Reinhardt et al.

(10) Patent No.: US 7,344,339 B1
(45) Date of Patent: Mar. 18, 2008

(54) HOSE GUIDE

(76) Inventors: Noel Reinhardt, 250-20 Thornhill Ave., Little Neck, NY (US) 11362; Halina Reinhardt, 250-20 Thornhill Ave., Little Neck, NY (US) 11362

( * ) Notice: Subject to any disclaimer, the term of this patent is extended or adjusted under 35 U.S.C. 154(b) by 0 days.

(21) Appl. No.: 11/679,816

(22) Filed: Feb. 27, 2007

(51) Int. Cl.
*B05B 15/06* (2006.01)

(52) U.S. Cl. ..... 405/184.4; 248/75; 248/80

(58) Field of Classification Search ..... 248/75, 248/76, 79, 80, 83, 85, 87; 405/184.4
See application file for complete search history.

(56) References Cited

U.S. PATENT DOCUMENTS 1,831,306 A * 11/1931 Kakimoto ..... 248/85
5,788,193 A * 8/1998 Hilbert ..... 248/80
5,881,419 A * 3/1999 Millard ..... 248/80
6,332,595 B1 * 12/2001 Klucznik ..... 248/80

* cited by examiner

*Primary Examiner*—Frederick L. Lagman

(57) ABSTRACT

A hose guide that allows an individual to stretch a hose over a fence in a commercial or residential setting, and by doing so, avoiding damage to either the hose or the fence. The hose guide includes two separate posts that can be each mounted on individual slats of a fence, with a center tube connecting the two separate posts. Each of the posts and the center tube have a bottom-mounted slot that allows the hose guide to be easily mounted onto the slats of a fence, allowing a hose to rest atop the center tube as it travels over the fence and not touch individual components on the fence.

3 Claims, 3 Drawing Sheets

HOSE GUIDE

BACKGROUND OF THE INVENTION

The present invention concerns that of a new and improved hose guide that allows an individual to stretch a hose over a fence in a commercial or residential setting, and by doing so, avoiding damage to either the hose or the fence.

DESCRIPTION OF THE PRIOR ART

United States Application 2005/0184203, filed by Votypka, discloses a hose holding device that can be mounted on a fence via a peg.

U.S. Pat. No. 6,332,595, issued to Klucznik, discloses a stand to support and suspend a hose above a surface.

United States Application 2001/0028021, filed by Martin, discloses a hose guide and supportive device.

U.S. Pat. No. 5,549,262, filed by Whitehead, discloses a hose guide with a C-shaped hose support member.

U.S. Pat. No. 2,536,341, filed by Asher, discloses a hose holding device.

SUMMARY OF THE INVENTION

The present invention concerns that of a new and improved hose guide that allows an individual to stretch a hose over a fence in a commercial or residential setting, and by doing so, avoiding damage to either the hose or the fence. The hose guide includes two separate posts that can be each mounted on individual slats of a fence, with a center tube connecting the two separate posts. Each of the posts and the center tube have a top-mounted slot that allows the hose guide to be easily mounted onto the slats of a fence, allowing a hose to rest atop the center tube as it travels over the fence and not touch individual components on the fence.

There has thus been outlined, rather broadly, the more important features of a hose guide that the detailed description thereof that follows may be better understood and in order that the present contribution to the art may be better appreciated. There are, of course, additional features of the hose guide that will be described hereinafter and which will form the subject matter of the claims appended hereto.

In this respect, before explaining at least one embodiment of the hose guide in detail, it is to be understood that the hose guide is not limited in its application to the details of construction and to the arrangements of the components set forth in the following description or illustrated in the drawings. The hose guide is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present hose guide. It is important, therefore, that the claims be regarded as including such equivalent constructions insofar as they do not depart from the spirit and scope of the present invention.

It is therefore an object of the present invention to provide a hose guide which has all of the advantages of the prior art and none of the disadvantages.

It is another object of the present invention to provide a hose guide which may be easily and efficiently manufactured and marketed.

It is another object of the present invention to provide a hose guide which is of durable and reliable construction.

It is yet another object of the present invention to provide a hose guide which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
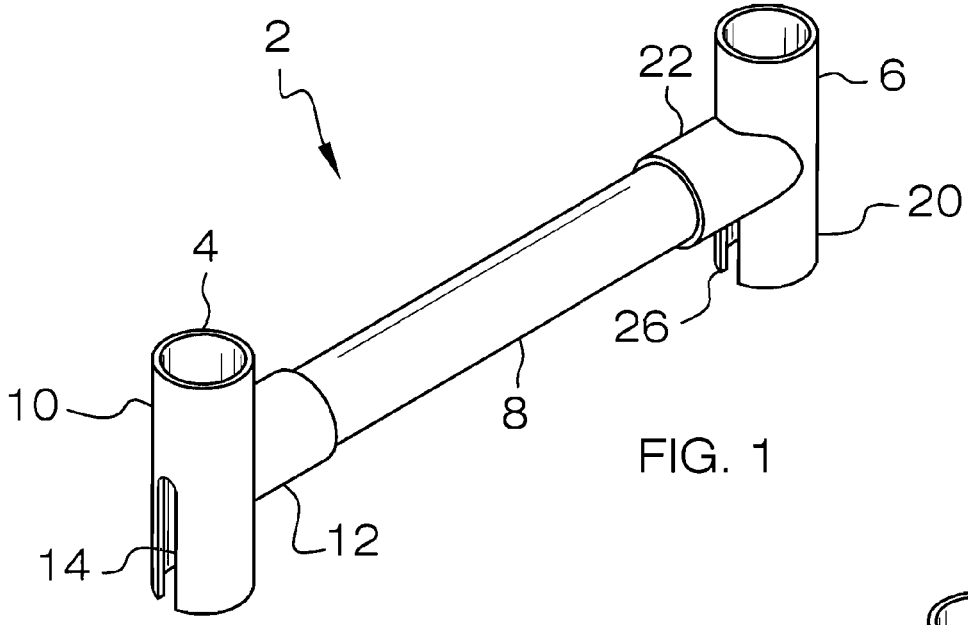
FIG. 1 shows a top perspective view of the hose guide.
Figure 2:
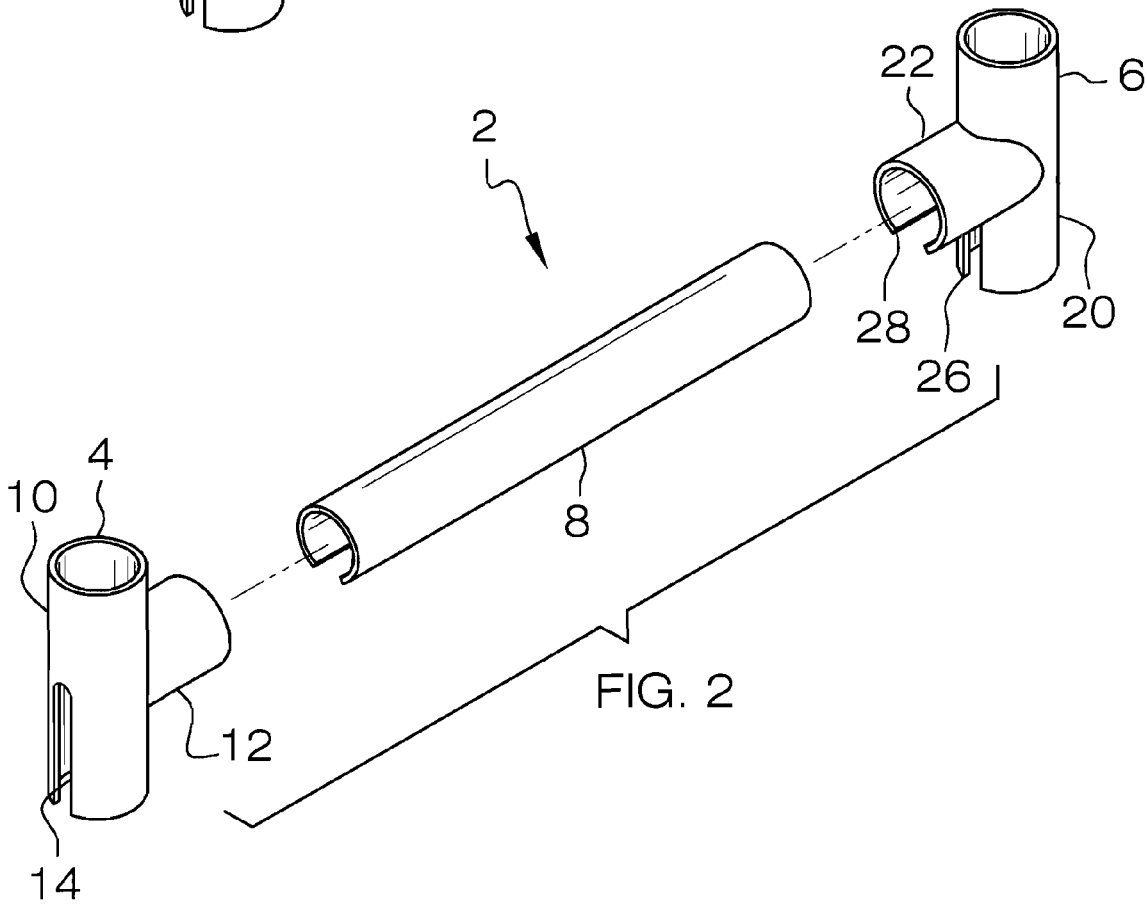
FIG. 2 shows a top perspective view of the hose guide as it would appear in a disassembled state.
Figure 3:
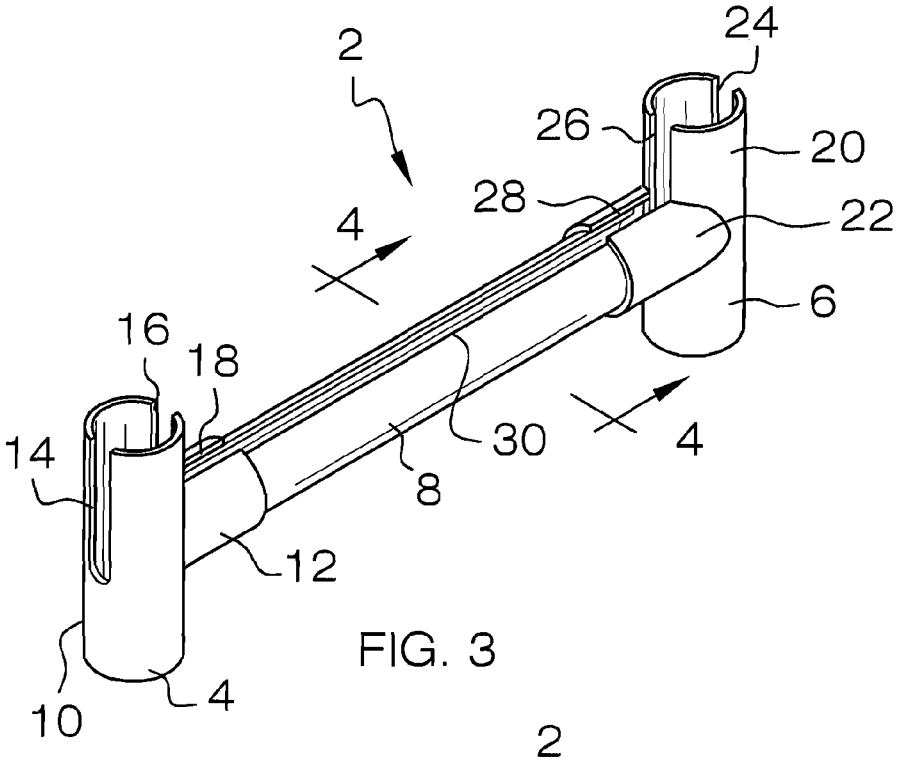
FIG. 3 shows a bottom perspective view of the hose guide.
Figure 4:
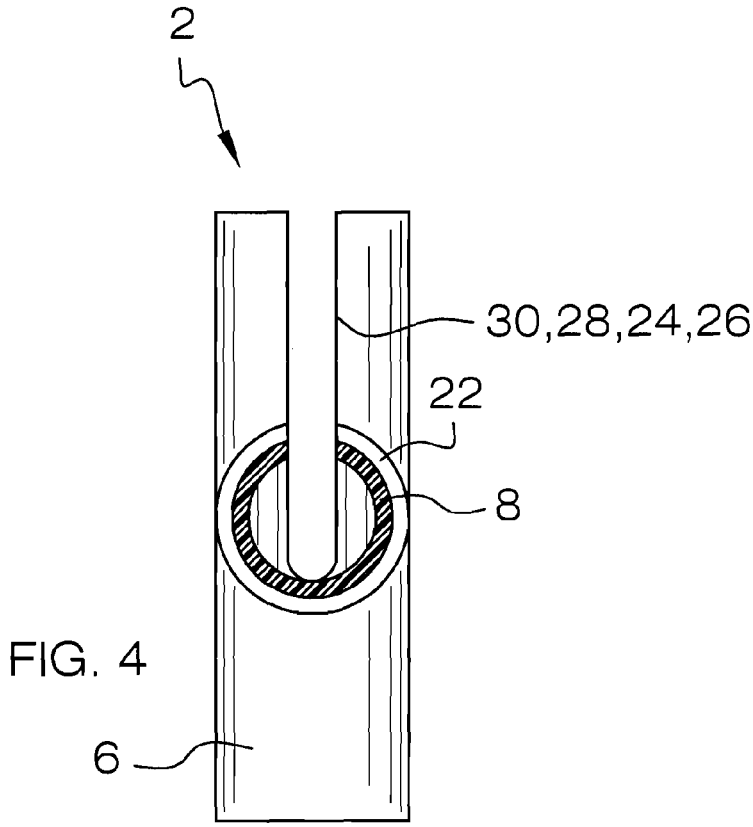
FIG. 4 cross section view of FIG. 3 taken along line 4-4 of the hose guide.
Figure 5:
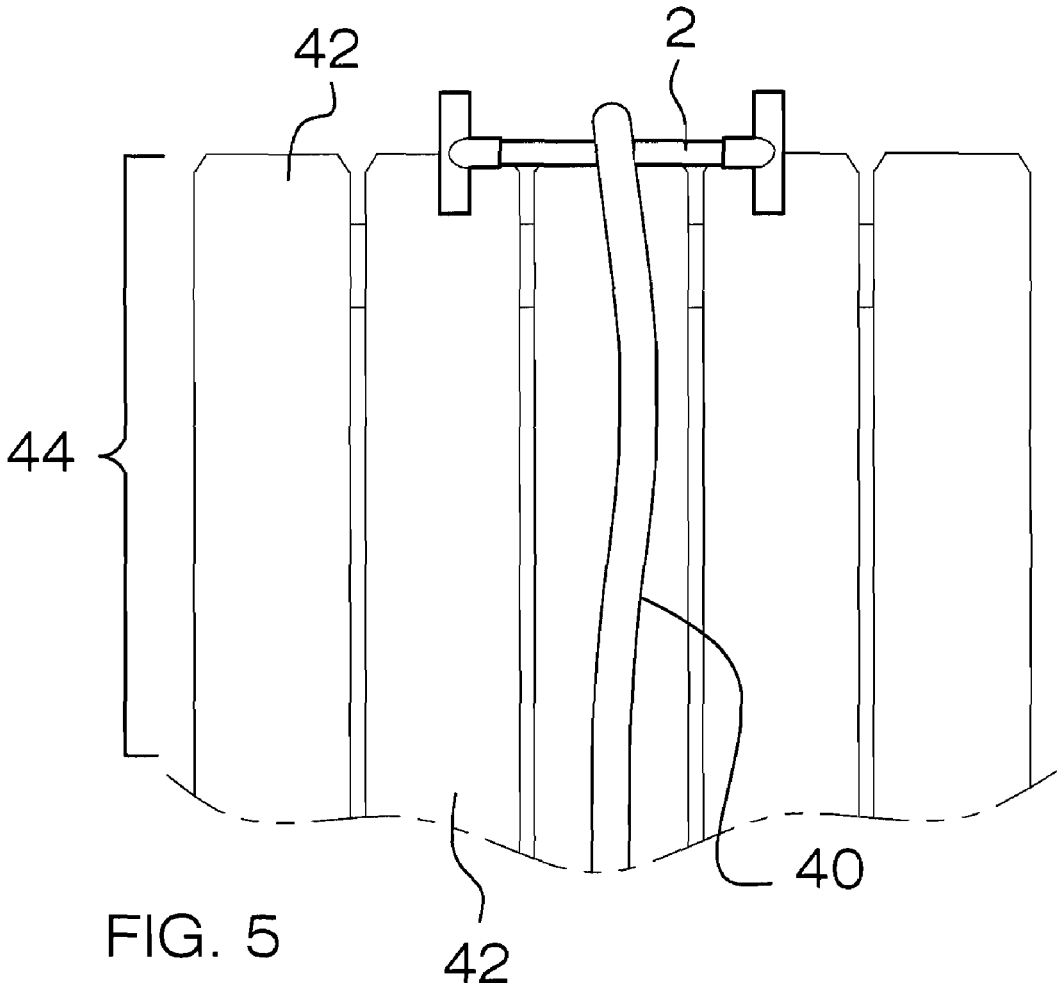
FIG. 5 shows a side view of the hose guide as it would be seen in use.

With reference now to the drawings, and in particular to FIGS. 1 through 5 thereof, a new hose guide embodying the principles and concepts of the present invention and generally designated by the reference numeral 2 will be described.

As best illustrated in FIGS. 1 through 5, the hose guide 2 comprises a left post 4 that comprises a primary tube 10, with the primary tube 10 having two ends comprising an upper end and a lower end. The left post 4 also has a support tube 12 that has two ends comprising a first end and a second end, with the first end of the support tube 12 being attached to the primary tube 10 of the left post 4 approximately halfway between the upper end and the lower end of the primary tube 10.

The hose guide 2 further comprises a right post 6 that comprises a primary tube 20, with the primary tube 20 having two ends comprising an upper end and a lower end. The right post 6 also has a support tube 22 that has two ends comprising a first end and a second end, with the first end of the support tube 22 being attached to the primary tube 20 of the right post 6 approximately halfway between the upper end and the lower end of the primary tube 20.

The hose guide 2 also has a center tube 8 that has two ends comprising a first end and a second end. The first end of the center tube 8 is removably insertable into the support tube 12, while the second end of the center tube 8 is removably insertable into the support tube 22.

The left post 4 has a plurality of slots to allow placement of the left post 4 over the slats 42 in a fence 44. Outer slot 14 and inner slot 16 are both located on the lower end of the primary tube 10 and are located one hundred eighty degrees from one another. Furthermore, the outer slot 14 and inner slot 16 are located in a co-linear fashion to the positioning of the center tube 8 once the center tube 8 is attached to the left post 4 and the right post 6. Furthermore, lower slot 18 is located on the support tube 12 of left post 4.

Similar to the left post 4, the right post 6 has a plurality of slots to allow placement of the right post 6 over the slats 42 in a fence 44. Outer slot 24 and inner slot 26 are both located on the lower end of the primary tube 20 and are located one hundred eighty degrees from one another. Furthermore, the outer slot 24 and inner slot 26 are located in a co-linear fashion to the positioning of the center tube 8 once the center tube 8 is attached to the left post 4 and the right post 6. Furthermore, lower slot 28 is located on the support tube 22 of right post 6.

Center tube 8 also has a slot, which is center slot 30. Center slot 30 runs the entire length of the center tube 8. When the first and second ends of center tube 8 are attached to the left post 4 and right post 6, respectively, the center slot 30 is preferably lined up with the lower slot 18 on the support tube 12 of the left post 4 and the lower slot 28 on the support tube 22 of the right post 6. By doing this, all of the seven slots discussed herein on the hose guide are co-linear to one another.

In use, an individual can mount the left post 4 and the right post 6 of the hose guide 2 on individual slats 42 of a fence 44 wherein the lower end of the left post and the lower end of the right post can be placed over the slats 42 in the fence 44. Providing the hose guide 2 is co-linear with the fence 44, the hose guide 2 can be pushed downward until the hose guide 2 is securely mounted on the fence 44. The individual slats 42 on the fence 44 will pass through the seven slots on the hose guide 2 discussed herein and will only be halted from further progress once the slats are placed into contact with the inside surface of the center tube 8 opposite the center slot 30.

Once in place, a hose can be run over the center tube 8 of the hose guide 2. In doing so, the hose 40 will not touch the fence 44 at all, thereby preventing any damage to the hose 40 or fence 44 at all. The hose 40 will be kept in place on top of the center tube 8 because of the presence of left post 4 and right post 6, which will prevent the hose 40 from slipping off of its position atop the center tube 8.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Thus, another embodiment of the present hose guide which fits within the written description provided herein may also comprise a single injected molded piece or other form.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A hose guide comprising a) a left post, the left post further comprising (i) a first primary tube having two ends comprising an upper end and a lower end, (ii) a first support tube having two ends comprising a first end and a second end, (iii) wherein the first end of the first support tube is fixedly attached to the first primary tube approximately halfway between the upper end of the first primary tube and the lower end of the first primary tube, b) a right post, the right post further comprising (i) a second primary tube having two ends comprising an upper end and a lower end, (ii) a second support tube having two ends comprising a first end and a second end, and (iii) wherein the first end of the second support tube is fixedly attached to the second primary tube approximately halfway between the upper end of the second primary tube and the lower end of the second primary tube, c) a center tube having two ends comprising a first end and a second end, d) means for connecting the first end of the center tube to the left post, said means further comprising (i) the first support tube attached to the left post, (ii) wherein the first end of the center tube is removably inserted into the first support tube attached to the left post, e) means for connecting the second end of the center tube to the right post, said means further comprising (i) the second support tube attached to the right post, (ii) wherein the second end of the center tube is removably inserted into the second support tube attached to the right post, f) means for providing support for a hose; wherein the means for providing support for a hose further comprises at least one slot accessible through the lower end of the first primary tube of the left post; a lower slot located on the first support tube of the left post; at least one slot accessible through the lower end of the second primary tube of the right post; a lower slot located on the second support tube of the right post; a slot located on the center tube; wherein the lower end of the left post and the lower end of the right post can be placed over individual slats in a fence; and further wherein the hose, from one side of the fence to the other side of the fence, can be placed over the top of the center tube.

2. A hose guide according to claim 1 wherein the left post further comprises (a) an outer slot located on the upper end of the first primary tube of the left post, (b) an inner slot located on the upper end of the first primary tube of the left post, (c) wherein the outer slot and the inner slot on the left post are located one hundred eighty degrees from one another, and (d) further wherein the outer slot and the inner slot on the left post are co-linear to the positioning of the center tube once the center tube has been attached to the left post and the right post.

3. A hose guide according to claim 2 wherein the right post further comprises (a) an outer slot located on the upper end of the second primary tube of the right post, (b) an inner slot located on the upper end of the second primary tube of the right post, (c) wherein the outer slot and the inner slot on the right post are located one hundred eighty degrees from one another, and (d) further wherein the outer slot and the inner slot on the right post are co-linear with the center tube.

* * * * *